United States Patent [19]

Strolenberg

[11] 4,025,055

[45] May 24, 1977

[54] APPARATUS FOR USE IN RAISING OR LOWERING A LOAD IN A CONDITION OF RELATIVE MOTION

[76] Inventor: Willem Josef George Strolenberg, 3, The Weavers, The Green, Long Melford, Suffolk, England

[22] Filed: July 7, 1975

[21] Appl. No.: 593,505

[30] Foreign Application Priority Data

July 30, 1974 United Kingdom ..... 33589/74

[52] U.S. Cl. ..... 254/172; 214/14; 212/3

[51] Int. Cl.[2] ..... B66D 1/48

[58] Field of Search ..... 254/173 R, 172, 186 R; 214/14, 12, 15 R; 212/3, 57, 58 R, 144, 35

[56] References Cited

UNITED STATES PATENTS

| | | | |
|---|---|---|---|
| 1,999,936 | 4/1935 | Lange | 254/172 |
| 2,732,180 | 1/1956 | Gratzmuller | 254/172 |
| 3,294,369 | 12/1966 | Butler | 254/172 |
| 3,512,657 | 5/1970 | Chambers | 214/14 |
| 3,662,991 | 5/1972 | Lakiza et al. | 254/172 |
| 3,793,835 | 2/1974 | Larralde | 254/172 |
| 3,804,183 | 4/1974 | Duncan et al. | 254/172 |
| 3,871,527 | 3/1975 | Schimmeyer et al. | 254/172 |

*Primary Examiner*—L. J. Paperner
*Assistant Examiner*—Kenneth Noland
*Attorney, Agent, or Firm*—Steele & Petock

[57] ABSTRACT

Motion compensated load lifting apparatus for use on marine vessels. Apparatus includes means for maintaining tension in load lifting member during relative motion and means for locking the tensioning means in one direction of motion. Tensioning means includes high and low pressure accumulators which enable compressed fluid to act on linear or rotary drives to apply high and low tension. Load rises and falls with vessel under high tension but weight is mainly offset. Locking means, such as ratchet and pawl or pilot-operated valve, is selected to lift load from vessel at crest of relative motion. Tension can be applied with linear ram, rotary drive or through differential drive.

27 Claims, 8 Drawing Figures

APPARATUS FOR USE IN RAISING OR LOWERING A LOAD IN A CONDITION OF RELATIVE MOTION

This invention relates to apparatus for use in raising or lowering a load in a condition of relative motion between the location of the apparatus and the location of the load. The invention can, in particular, be embodied in a crane mounted on an offshore structure, which crane is used for unloading, or loading a supply vessel moored nearby whereby, when the load is raised or lowered, the apparatus compensates for relative motion between the crane and the vessel caused by waves.

When the sea is rough, a vessel may move up and down more than ten feet about a reference position and unloading or loading must be suspended because of the hazard to personnel. The relative motion between, for example, the hook connected to a winch in a crane mounted on an offshore structure and the deck of a vessel moored adjacent the structure, not only makes it difficult to attach a load to the hook, but also makes it dangerous to raise or to lower the load. For example, if a load of drill pipes or casings are attached to the hook and the lifting line is tensioned when the deck of the vessel is falling, the deck may subsequently rise faster than the rate at which the load is raised and the vessel would than collide with the load probably causing drilling pipes and casings to fall back onto the vessel. Moreover, once the hook has been attached to the load the vessel may fall beyond a point where the slack in the line is taken up thereby causing a sudden shock loading to be applied to the crane. Such a shock loading is deleterious to the crane and increases the hazard of load swing and hence collision between the load and the vessel or even personnel.

The apparatus of the present invention seeks to reduce, or to eliminate the latter problems whereby, for example, a supply vessel moored adjacent an offshore structure can be unloaded, or loaded in conditions during which work is normally suspended. This saves time and considerable expense in offshore drilling because work is normally suspended in foul weather when supplies cannot be loaded onto a rig.

The invention provides apparatus for use either in raising a load in a condition of relative motion between the apparatus and a support for the load, or in lowering a load in a condition of relative motion between the apparatus and a support for receiving the load, the apparatus comprising primary drive means for withdrawing, or for advancing a load supporting member relative to the location of the load; tensioning means active, in use, to apply and to maintain a tension in said load supporting member to compensate for said relative motion when the load is positioned on said support and is attached to said load supporting member; and means for locking said tensioning means so that it is caused to become inactive in at least one direction of motion of said load supporting member.

The tensioning, means can be arranged between the primary drive means and the load supporting member. For example, when the load supporting member comprises a line, a bite, or section of the line is entrained about a secondary hydraulic drive which is positioned between the primary drive and a lifting block. Alternatively, the tensioning means can be coupled directly to the primary drive means, for example, when the primary and secondary drives are coupled through a differential drive.

Preferably, said tensioning means comprises means to apply different tensions to said load supporting member. For example the tensioning means can comprise hydraulically operated second drive means; means for enabling either high or low pressure gas to act on hydraulic fluid supplied to said drive means; means for smoothing the hydraulic secondary drive when changing the hydraulic pressure by changing the gas pressure; and means for coupling the hydraulic secondary drive to said load supporting member.

The preferred hydraulically operated secondary drive may be linear, for example, it may include a piston or pistons arranged to act on a bite or a section of the line. Alternatively, said secondary drive may be a rotary drive coupled either to an independent line storage drum or to a line storage drum forming part of the primary drive.

A reeving system or a gearing system (such as a differential gear), or both, may be used to adjust the velocity ratio between the hook attached to a line in the load supporting member and said tensioning means. The velocity ratio is adjusted, in practice, to provide the required "hook-speed" with respect to the secondary drive and, where necessary, to take account of the limit of motion in the secondary drive (for example, the extent of piston travel in a linear drive). Suitable arrangements enable the apparatus too be made in a more compact form and greater compactness is enabled by using a differential drive.

In a system including an hydraulically operated secondary drive, the hydraulic fluid can be acted upon by either the low or high pressure gas in respective hydropneumatic accumulators. These accumulators can be connected to regulated supplied of gas or they can be pre-loaded with gas. In this case, said smoothing means preferably comprises means for preventing an hydraulic lock, for example, an auxiliary accumulator or accumulators which communicate with the hydraulic field system of the secondary hydraulic drive. A valve is provided for selectively coupling either the high, or the low pressure accumulator to the hydraulic drive. The auxiliary accumulator is preferably a pre-loaded hydropneumatic accumulator. However, other means may be employed such as a spring-biased or weight-loaded piston.

As an alternative to an hydraulic/gas system, said tensioning means could be an "all-gas" system. However, such an alternative may require compessors in order to make-up gas pressure, for example, pressure which is lost when high pressure gas is bled-off before selecting low pressure gas. In view of the latter the hydraulic/gas system is preferred.

In one preferred embodiment, a selectable unidirectional locking device such as a ratchet and pawl mechanism is provided to cause said tensioning means to become inactive in one direction of motion of said load supporting member. A manually selectable pawl gives the operator more control over the raising and lowering of loads. However, the pawl could be automatically selected after sensing said relative motion.

In a second preferred embodiment, the unidirectional locking device comprises a pilot operated non-return valve provided in the hydraulic circuit of an hydraulically operated secondary drive, the pilot operated valve being selected to prevent the flow of hydraulic fluid in one direction.

An advantage of a ratchet and pawl mechanism is that the pawl can, if selected, travel freely over the teeth when a load is displaced in one direction (for example, when the deck of a supply vessel is rising) and it will then engage the teeth when the load moves in the opposite direction (for example, when the deck of the vessel falls). This ensures that the primary drive is effective at an optimum point during said relative motion (for example, at or near the crest of the vessel's motion). A further advantage is that the pawl is automatically disengaged if load is again supported (for example, if the deck of the vessel meets the load when the deck rises faster than the load is being raised). A similar effect is given by a "non-return" pilot operated valve. If the pilot operated valve is not a non-return valve, it would require means to become inactive in one direction of motion of the load supporting member. For example, a load sensor could be provided to sense a drop in tension on the load supporting member so as to operate the pilot operated valve.

When said tensioning means comprises a linear drive, such as a piston and cylinder, the cylinder is preferably pivotally mounted at one end to enable it to be variably inclined, one end of a member attached to the piston being mounted for slidable movement relative to a track. The linear drive can be overriden by means of a ratchet and pawl mechanism acting between the movable end of said member and said track or a pilot operated valve acting in the hydraulic system. An inclined linear drive reduces force variation on the load lifting member (for example, due to changing hydraulic pressure).

When a rotary hydraulic drive is used for compensation, it can be coupled to a drum for storing a length of line forming the load supporting member. Such a drum can be independent of the primary drive (for example, when used with a reeving system) or it can be a part of the primary drive (for example, when used with a differential drive). When it is independent, a tapered drum can be used to reduce the force variation on the load lifting member. Such a drive can be used with either a selectable ratchet and pawl fitted to the drum or a non-return pilot operated valve which is located in the hydraulic fluid line to the rotary drive.

In order to provide more stability when lowering a lod onto the deck of the vessel, the deck can be equipped with a winch having a line which preferably passes under a pulley and is secured to the load supporting member, for example, to a hook attached to a line, whereby the winch applies a tension to overcome the strong bias applied by the tensioning means and the hook is lowered under a controlled tension to compensate for said relative motion.

The hydraulically operated drive means preferably includes means for adjusting at least the high pressure of said gas whereby the amount of said strong bias is adjusted to suit the load.

Examples of the invention will now be described with reference to the accompanying schematic drawings in which.

Figure 1:
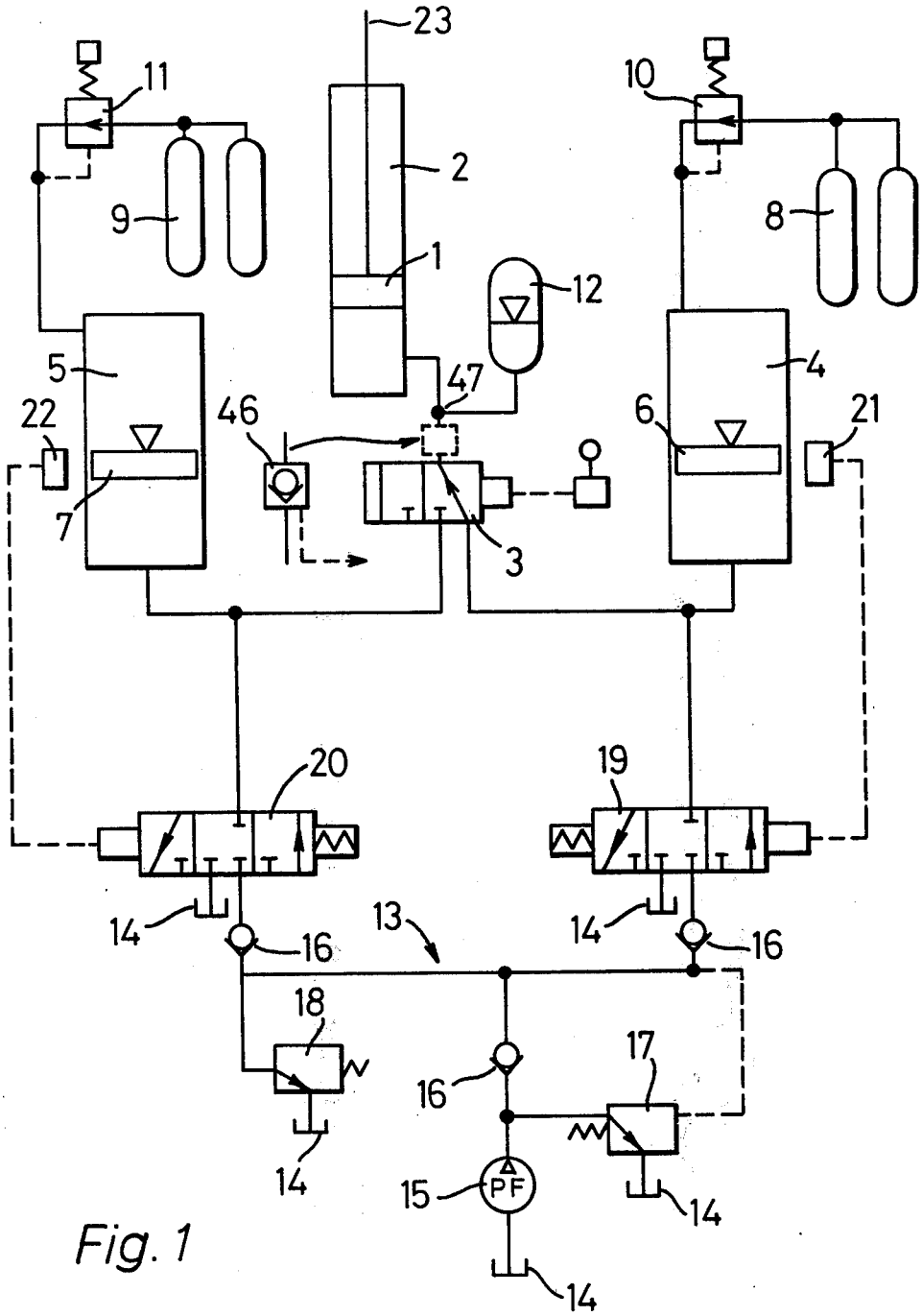
FIG. 1 is a schematic hydraulic circuit applicable to a linear hydraulically drive tensioning means for applying a varying force to a piston.

Referring to FIG. 1, a description will first be given of tensioning means for applying different forces to a piston 1 housed in a cylinder 2, for example, to compensate for relative motion between an offshore crane and a supply vessel. The tensioning means includes a valve 3 which is selected manually to enable either high pressure gas in one or more hydro-pneumatic accumulators 4 or low pressure gas in one or more hydro-pneumatic accumulators 5 to act on the hydraulic fluid in cylinder 2. The gas is commonly separated from the hydraulic field in the accumulators 4, 5 by, for example, floating pistons 6, 7 or by elastic bladders.

The accumulators 4, 5 are provided with compressed gas from respective cylinders 8, 9 which cylinders are commonly connected to respective pressure regulators 10, 11. The regulators 10, 11 enable the gas precharge pressure in each of the accumulators 4, 5 to be adjusted.

A single auxiliary hydro-pneumatic accumulator 12, precharged with gas, is connected into the pipeline between the valve 3 and the cylinder 1 to alleviate hydraulic shocks.

Hydraulic fluid is supplied to accumulators 4, 5 by make-up system 13, comprising reservoir 14, continuously operating pump 15, non-return valves 16, pilot operated pressure relief valve 17, safety valve 18 and three-position selector valves 19, 20. Valves 19, 20 are actuated by control means, such as solenoid or air or hydraulic pilot, responsive to signals from sensor means indicative of the volume of hydraulic fluid in accumulators 4 and 5 respectively. By way of example sensors 21, 22 in FIG. 1 detect the position of floating pistons 6 and 7 respectively. If accumulators 4, 5 were of the type with bag separators, pressure sensors could be provided to give a signal indicative of fluid volume in the accumulators. If the fluid volume is too low, pump 15 draws fluid from reservoir 14 and passes it through non-return valves 16 and valve 19 or valve 20 to the respective accumulator. Valve 17 releases pump flow to reservoir when a predetermined pressure is reached in the make-up system.

The device functions as follows:

Assume that a low pressure is to be first applied to piston 1 and thereby the connecting member 23. The position of valve 3 is selected whereby the gas in accumulator 5 acts on the hydraulic fluid exerting a predetermined pressure of, for example 200 psi. The low pressure enables member 23 to be moved against a light bias.

Assuming now that a strong bias must be applied against member 23, the position of valve 3 is selected to enable the gas under the higher pressure, in accumulator 4 to act on the hydraulic field. The pressure of the gas in accumulator 4 may be, for example, 2000 psi.

The auxiliary accumulator 12 alleviates shock loads imparted to the piston and thus to the crane structure when the valve 3 is changed over, causing a sudden change in pressure.

The device of FIG. 1 does not consume any compressed gas because it is merely moved backwards and forwards in a closed system.

A description now follows of a motion compensated lifting system in which the tensioning means of FIG. 1 is embodied.

Figure 2:
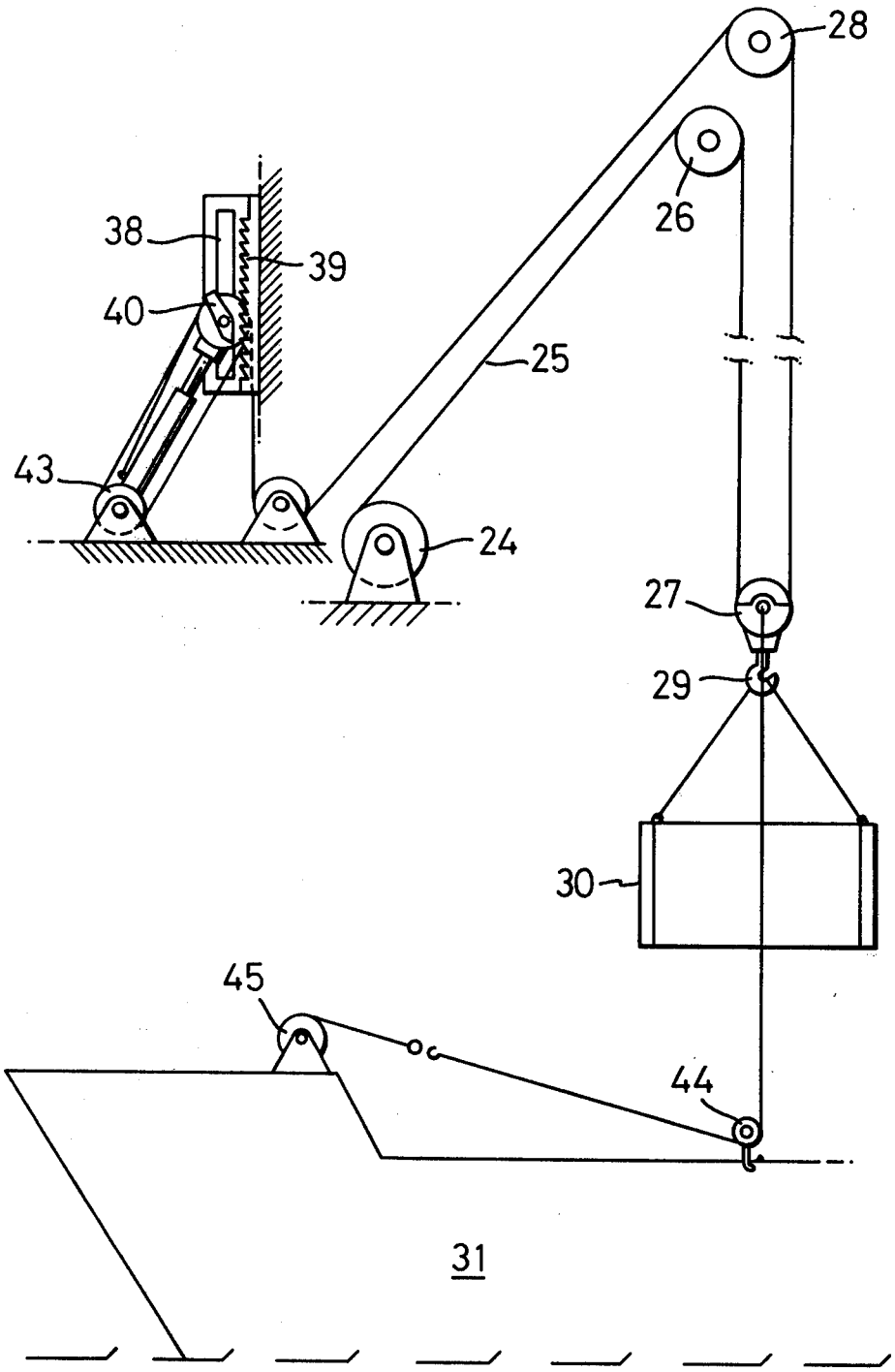
FIG. 2 shows a first embodiment of a motion compensated lifting system with a linear, inclined hydraulically driven tensioning means.
Figure 3:
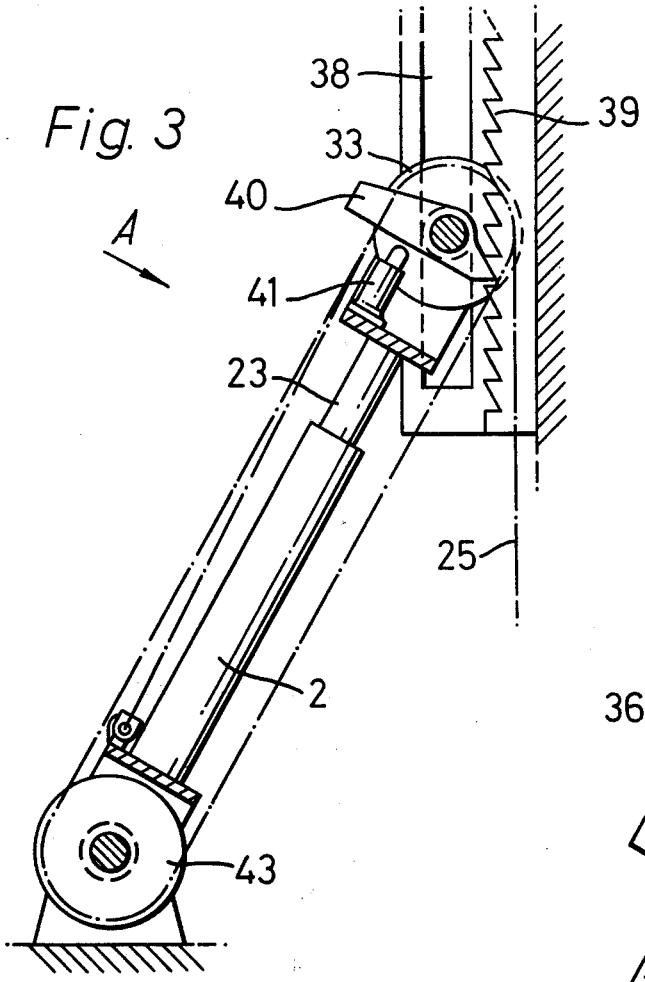
FIG. 3 shows detail of the linear inclined hydraulic tensioning means with ratchet locking means.
Figure 3A:
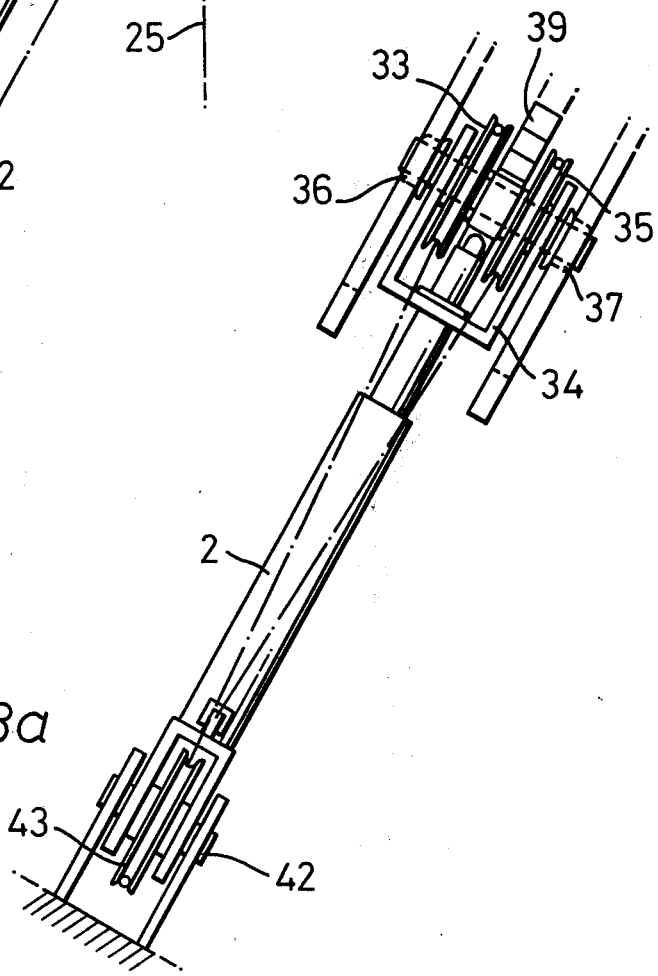

Referring to FIGS. 2 and 3, a winch 24 stores a line 25 which passes over a pulley 26 supported on the jib (not shown) of a crane and then towards, and around, a block 27 and then back to a pulley 28 on the jib. A hook 29 is attached to block 27 for attachment to a load 30. Load 30 is shown in a raised position above the deck of a vessel 31 which is moored adjacent a rig (not shown) on which the crane is mounted. Assuming that the furthest end of line 25 is fast, anti-clockwise rotation of winch 24 will raise load 30 from the deck of vessel 31.

Line 25 extends from the pulley 28 towards, and around, a freely rotatable pulley 32. It is then entrained about a pulley 33 which is rotatably mounted on a bracket 34 fixed to one end of member 23. Bracket 34 supports a second pulley 35 and rollers 36, 37 which run on tracks 38 between which is fixed a rack 39 with ratchet teeth. A selectively engageable pawl 40, engages teeth on rack 39 to provide a ratchet action when number 23 extends and moves rollers 36, 37 up the tracks 38. Pawl 40 is either held clear of or allowed to engage with rack 39 by means of actuator 41 mounted on bracket 34. Actuator 41 may be for example a pneumatic ram.

The cylinder 2 is pivotally mounted on a shaft 42 which supports a free running pulley 43. Line 25 passes from pulley 32, over pulleys 33, 43, 35 and is then attached to cylinder 2.

The cylinder 2 is inclinable about shaft 42 at angles of, for example, 60 to 75% to the horizontal. The angular range, over which the cylinder 2 is inclined, reduces the load variation on the line 25 due to change in accumulator pressure as piston 1 moves in cylinder 2.

In use, valve 3 is selected whereby the low pressure gas in accumulator 5 acts upon the hydraulic fluid in cylinder 2. This causes a relatively light bias to be exerted on member 23 and hence on line 25 whereby hook 29 may be drawn down to the deck of a vessel 31 by means of a light line attached to the hook and passed round pulley 44, secured to the vessel, and connected to winch 45 also on the vessel. As the vessel moves up and down in the sea, the light bias, acting through movements of member 23 acts to keep the line taut without exerting an appreciable pull.

Valve 3 is then moved to enable the high pressure gas to act on the hydraulic fluid in cylinder 2 whereby a high proportion of the load is taken by the tension applied to line 25 through member 23. Pawl 40 is selected whilst the vessel is rising to override the tensioning means comprising the cylinder 2 and piston 1. For example, if the deck of vessel 31 is rising, the pawl 40, first slides over the rack 39 as the angle of inclination of cylinder 2 becomes steeper. When the deck of the vessel 31 falls, the pawl engages the nearest tooth on the rack whereby the tensioning means is locked in one direction of motion of the load and the winch 24 is then operated to raise the load. It will be appreciated the a major proportion of the load is taken by the tensioning system, when accumulator 4 is connected to cylinder 2 as the deck of the vessel rises and falls with the sea.

The apparatus can be used to transfer a load from the rig to the vessel31, for example, personnel can be transferred in a basket fixed to hook 29. In this case valve 3 is selected to connect accumulator 4 to cylinder 2 with the gas pressure adjusted to provide a bias in line 25 in excess of the load on hook 29. Member 23 is therefore fully extended whilst winch 24 unwinds to lower the basket towards the deck of vessel 31. When the basket is within say, 10 feet of the deck of vessel 31 winch 24 is stopped and a light line connected to hook 29 is passed round pulley 44 and is connected to a winch 45. Winch 45 is then wound in order to apply sufficient tension to overcome the hydraulic force on member 23, whereby the basket is gradually lowered to a predetermined spot on the deck of vessel 31. As the vessel rises and falls in the sea, the basket will move with the deck of the vessel because member 23 can move relative to cylinder 2.

The pull exerted on the basket by winch 45 prevents the basket from swinging and thus personnel are more safely transferred to the supply vessel 31. The same procedure may be followed to lower a heavy load from the rig crane to the deck of the vessel.

It can thus be seen that the apparatus enables a vessel to be unloaded without imparting shocks to the load and the load can be winched up at the most favourable moment, i.e. when the vessel is at the crest of its upward motion. Should the vessel collide with the load, the pawl 40 drops out of the teeth of rack 39 and member 23 is again effective to compensate for relative motion.

Referring again to the unloading of vessel 31, when the load is swung over the deck of the rig, it is lowered until it touches the deck. The line 25 is then payed off winch 24 until member 23 is fully extended, the pawl 40 meanwhile riding up over the teeth of rack 39. Valve 3 is then selected in order to apply a light bias to member 23 and actuator 41 is extended to hold pawl 40 out of engagement with the ratchet. Another unloading cycle can then be effected.

A ratchet and pawl can be used in the system of FIG. 1 to cause the hydraulic drive to become inactive in one direction of motion of the line attached to the load. Alternatively, a pilot operated non-return valve 46 can be fitted between the tee 47 and valve 3. In the latter system, the pilot operated valve 46 enables piston 1 to have in one direction namely, the direction corresponding with raising the load (if the vessel rises and meets the load after the valve 46 has been selected).

When unidirectional locking means such as a ratchet and pawl is used, the tension, due to a load is supported by the ratchet and pawl and the tensioning means, such as a ram is not stressed. However, when a pilot operated non-return valve 46 is used, the tension due to the load is transferred to the ram.

Figure 4:
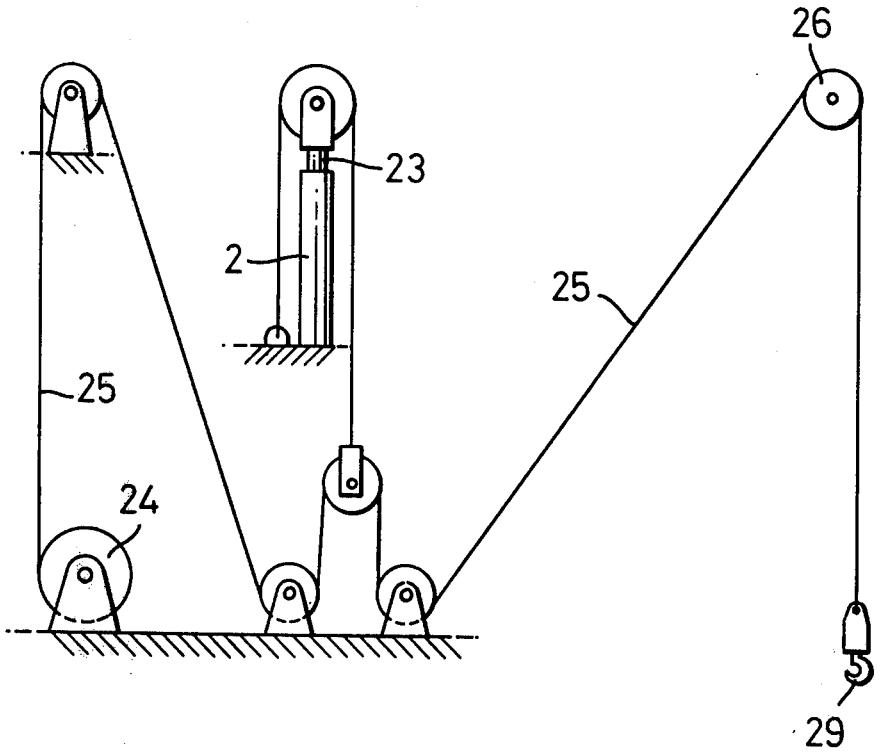
FIG. 4 illustrates a system with a linear, hydraulically driven tensioning means adapted for single fall reeving of the hoist rope and hydraulic locking.

FIG. 4 shows the compensating device, basically as shown in FIG. 2, adapted for a single fall hoist reeving arrangment and for unidirectional locking by means of a pilot operated non-return valve in the hydraulic system. This drawing also shows the ram in a fixed alignment, which leads to a simpler arrangement at the expense of some variation in tension due to pressure variation in the accumulators.

Figure 5:
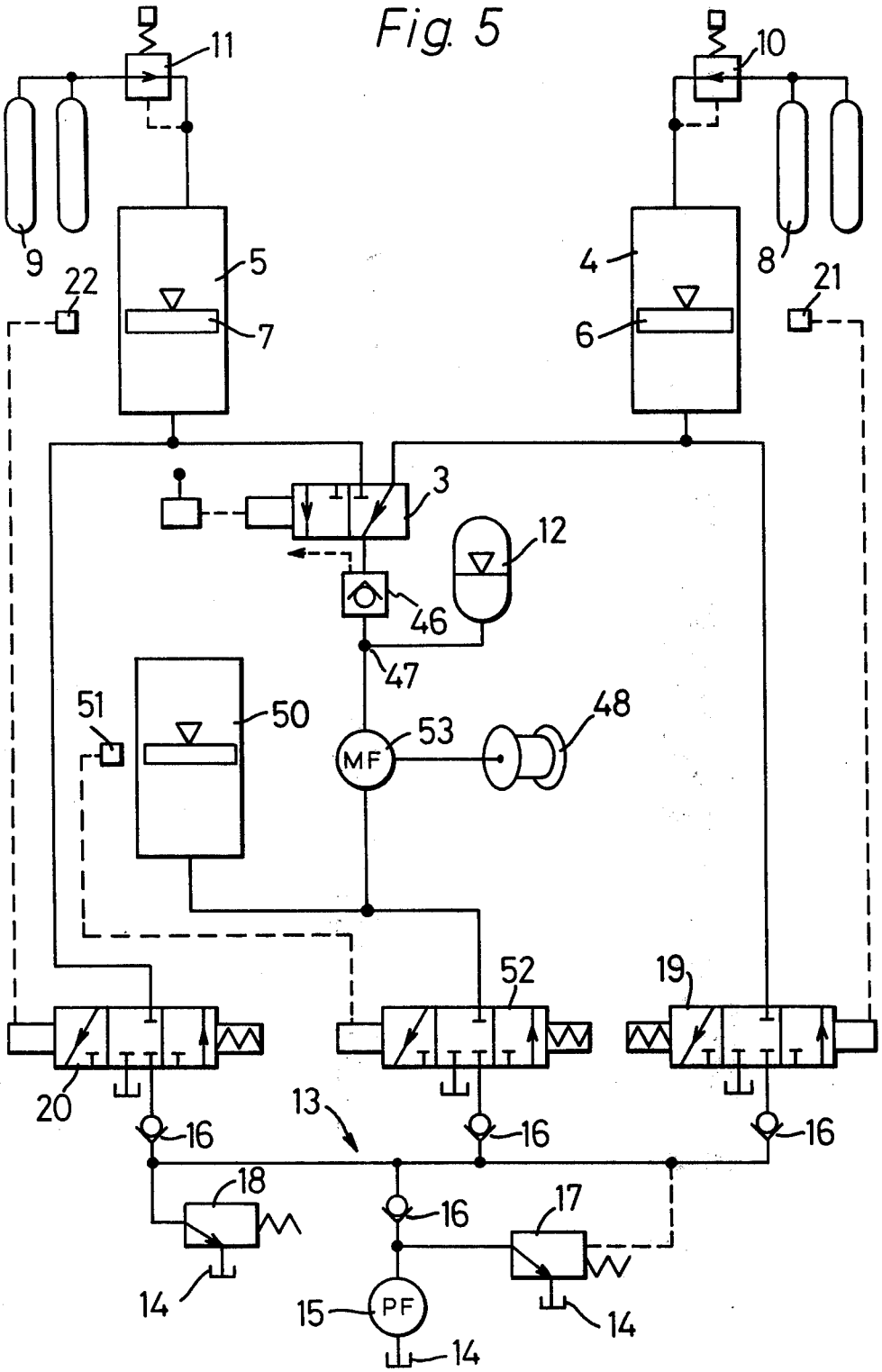
FIG. 5 is a schematic hydraulic circuit applicable to a rotary hydraulically driven tensioning means.
Figure 6:
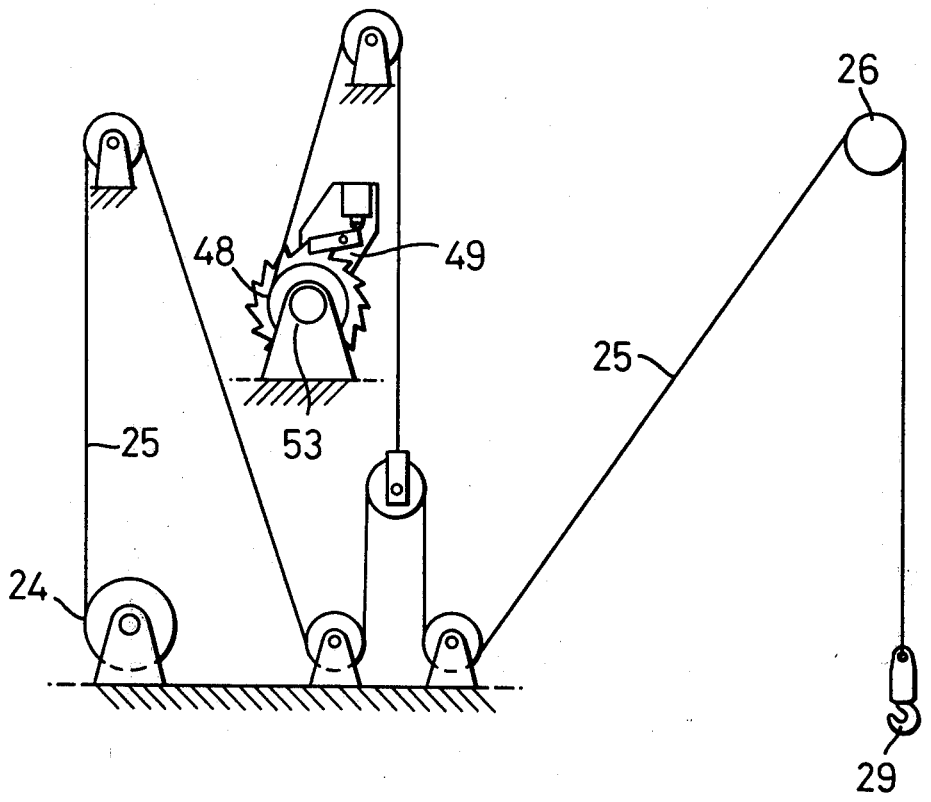
FIG. 6 shows an arrangement which employs a rotary hydraulic drive tensioning means.

FIG. 5 shows a schematic hydraulic circuit for a rotary hydraulic drive in which there is, for example, an hydraulic motor 53 connected directly to a storage drum 48 in the arrangement shown in FIG. 6. A ratchet mechanism 49 may be fitted to drum 47 as unidirectional locking means. However, the ratchet mechanism 49 can be replaced by a pilot operated non-return valve 46 in the hydraulic circuit of the tensioning system.

In the arrangement of FIG. 5, components similar to those shown in FIG. 1 have been given similar reference numerals and therefore need no further description. However, the system of FIG. 5 additionally provides a preloaded hydro-pneumatic accumulator 50, fitted with a transducer 51 which communicates with a solenoid valve 52. Accumulator 50 is provided to receive hydraulic fluid which energises hydraulic motor 53. The fluid flows from accumulator 4 or accumulator 5 through valve 3, motor 53 and then into the accumulator 50, in order to drive the motor in one direction. The fluid flows in the opposite direction to provide a reverse drive. Fluid in accumulator 50 is always at a lower pressure than that in accumlator 4 or 5.

Solenoid valve 52 is connected to the reservoir and make up system 13 as in FIG. 1 and operates in a similar manner.

Figure 7:
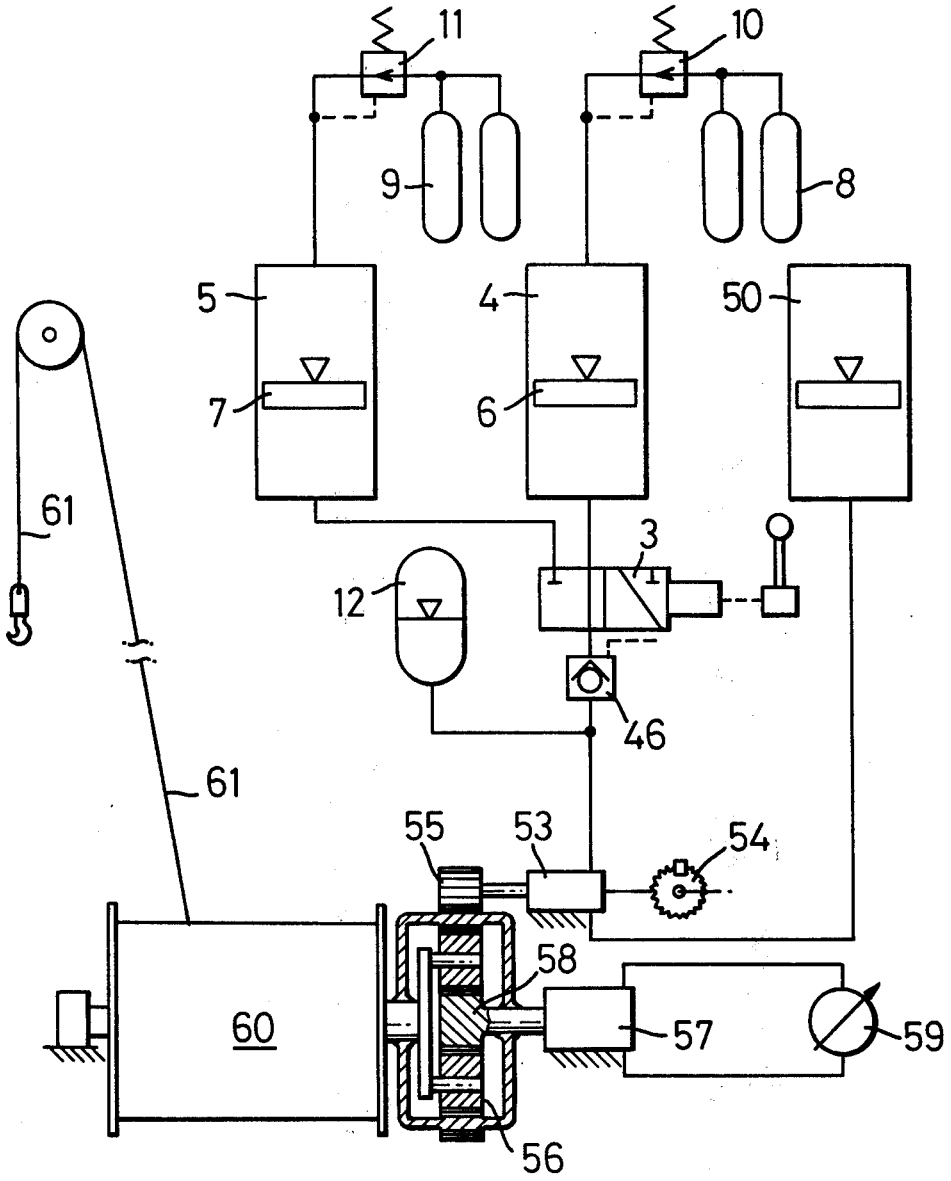
FIG. 7 shows a differential arrangement incorporating a rotary hydraulically driven tensioning means.

FIG. 7 schematically illustrates a differential drive which can be used with the rotary hydraulic motor 53 of FIG. 5. For the sake of example, the motor 53 is shown coupled to a ratchet device 54 but a pilot operated non-return valve 46 could also be used. For simplicity, the hydraulic circuit does not show the make-up and reservoir system 13 previously described with reference to FIG. 5.

The drive of motor 53 is connected to a gear 55 which meshes with a differential epicyclic drive 56. The drive of a main hoist motor 57 is also connected to a gear 58 which meshes with the epicyclic drive, motor 57 being driven by a variable swash pump 59. The output of the epicyclic drive is coupled to a winch 60 which stores a line 61 which passes to a jib head (not shown) for attachment to a load. Therefore, a section or bite of the line 61 is not required, as in the previous system, because of the direct main drive from motor 57 and the direct compensation by motor 53. The arrangement of FIG. 7 enables a compact system to be constructed.

In a further alternative, a non-inclinable ram with a single piston applies tension through a roller chain, the chain being fixed at one end, passing over a sprocket attached to the piston and a sprocket which can be releasably locked by e.g. a ratchet and pawl, and finally attached to a pulley block acting on a bite in the hoist line as in FIG. 4.

The device shown e.g. in FIG. 1 can be used in other applications where it is necessary to apply different forces to a movable member such as a linearly acting piston or a rotor in a rotary drive.

I claim:

1. An improvement in wave compensating apparatus for an off-shore crane, said crane being provided for unloading and loading a vessel which moves relative thereto due to wave motion, said crane including primary drive means, load attachment means and line means connecting said primary drive means to said load attachment means; said wave compensating apparatus including hydraulically driven means for taking up and paying out said line means, hydro-pneumatic means acting on said hydraulically driven means for tensioning said line means to compensate for said wave motion, said hydro-pneumatic means including first accumulator means for imparting a light tension to said line means, said light tension being equivalent to a minor proportion of the weight of said load, and unidirectional locking means for preventing said line means from lowering said load from the crest of said wave motion, the improving comprising:

second accumulator means for imparting a high tension to said line means, said high tension being applied to said line means for prestressing the load supporting system when unloading and for supporting said load when loading; said high tension being equivalent to a major proportion of, but not exceeding the weight of said load when unloading, and being greater than said load when loading; and selector means coupled to said first and second accumulator means and to said hydraulically driven means, said selector means operable to selectively connect said first and second accumulator means to said hydraulically driven means for applying said respective light and high tensions to said line means.

2. The improvement according to claim 1 wherein said hydraulically driven means comprises a ram arranged to act on a bite or a section of said line means.

3. The improvement according to claim 2 wherein said first and second accumulator means and said selector means comprise a closed hydro-pneumatic system; and wherein said first and second accumulator means each comprise first and second preloaded, hydro-pneumatic accumulators; and wherein said selector means comprises a hydraulic valve for selectively connecting said first and second accumulators to said ram.

4. The improvement according to claim 3 including means for smoothing said hydraulically driven means when said hydraulic selector valve is actuated for selectively connecting said first and second accumulator means to said ram.

5. The improvement according to claim 4 wherein said smoothing means comprises a third hydro-pneumatic accumulator, said third accumulator being connected between said ram and said hydraulic selector valve.

6. The improvement according to claim 5 wherein said unidirectional locking means comprises a pilot operated, non-return valve, said non-return valve being connected between said third accumulator and said hydraulic selector valve.

7. The improvement according to claim 6 wherein said ram is pivotally mounted at one end and is mounted for slidable movement at its other end whereby the inclination of said ram is variable.

8. The improvement according to claim 7 wherein said unidirectional locking means is operable to secure said ram at different angles of inclination.

9. The improvement according to claim 1 wherein said hydraulically driven means comprises a rotary drive, said rotary drive being operative for taking-up and paying out said line means, said rotary drive being connected between said selector means and third hydro-pneumatic accumulator means.

10. The improvement according to claim 9 wherein said first, second and third accumulator means and said selector means comprise a closed hydro-penumatic system; and wherein said first, second and third accumulator means each comprise respective preloaded, hydro-pneumatic accumulators; and wherein said selector means comprises a hydraulic valve for selectively connecting said first and second accumulators to said rotary drive.

11. The improvement according to claim 10 including means for smoothing said rotary drive when said hydraulic selector valve is actuated for selectively connecting said first and second accumulator means to said rotary drive.

12. The improvement according to claim 11 wherein said smoothing means comprises a fourth hyro-pneumatic accumulator, said fourth accumulator being connected between said rotary drive and said hydraulic selector valve.

13. The improvement according to claim 12 wherein said rotary drive is coupled to a tapered drum for reducing force variation on said line means.

14. The improvement according to claim 13 wherein said unidirectional locking means comprises a manually selectable ratchet connected to said drum.

15. The improvement according to claim 1 wherein said hydraulically driven means comprises a reversible hydraulic motor connected between said first and second accumulators and a third hydro-pneumatic accumulator, and including differential gear means coupled between said hydraulic motor and said primary drive for driving said drum.

16. The improvement according to claim 15 wherein said first, second and third accumulators and said selector means comprises a closed hydro-penumatic system; and wherein said first, second and third accumulators each comprise first, second and third preloaded, hydro-pneumatic accumulators; and wherein said selector means comprises an hydraulic valve for selectively connecting said first and second accumulators to said hydraulic motor.

17. The improvement according to claim 16 including means for smoothing said hydraulic motor when said hydraulic selector valve is actuated for selectively connecting said first and second accumulator means to said hydraulic motor.

18. The improvement according to claim 17 wherein said smoothing means comprises a fourth hydro-pneumatic accumulator, said fourth accumulator being connected between said hydraulic motor and said hydraulic selector valve.

19. The improvement according to claim 18 wherein said unidirectional locking means comprises a pilot operated, non-return valve, said non-return valve being connected between said fourth accumulator and said hydraulic selector valve.

20. The improvement according to claim 1 wherein said hydraulically driven means comprises a ram, pulley means attached to one end of said ram, the other end of said ram being relatively fixed, second line means having a relatively fixed end, displaceable pulley means attached to the other end of said line means; said second line means being entrained over said pulley means attached to said ram; and said first-mentioned line means being entrained over said displaceable pulley means whereby said first line means is compensated for said wave motion.

21. A wave compensated off-shore crane for unloading and loading a vessel which moves relative thereto due to wave motion, said crane including a winch, a reeving system, load supporting means and wave compensating means, said reeving system being connected to said winch and to said wave compensating means for raising and lowering said load supporting means and for compensating for said wave motion, said wave compensating means including:

an hydraulic ram;

first and second pulley means, said first pulley means being connected to one end of said ram and said second pulley means being connected to the other end of said ram;

first and second preloaded hydro-pneumatic accumulators, said preloading being provided by respective first and second sources of low and high pressure compressed gas, low pressure being provided for applying a light tension to said line means equivalent to a minor proportion of the weight of said load and said high pressure being provided for applying a high tension to said line means, which high tension is equivalent to a major proportion of, but does not exceed the weight of said load when unloading, and is greater than the weight of said load when loading;

an hydraulic selector valve, said selector valve connecting said first and second accumulators to said hydraulic ram; and unidirectional locking means for preventing retraction of said ram to prevent said line means from lowering said load from the crest of said wave motion.

22. A crane according to claim 21 in which said unidirectional locking means comprises a ratchet and pawl mechanism provided adjacent said first pulley means.

23. A crane according to claim 22 wherein said second pulley means of said hydraulic ram is fixed to the crane structure and said first pulley means is slidable on a track adjacent said ratchet whereby the inclination of said ram is variable.

24. A crane according to claim 23 including a third preloaded hydro-pneumatic accumulator connected to said hydraulic ram for smoothing the operation of said ram when said hydraulic selector valve is actuated for selectively connecting said first and second accumulators to said ram.

25. A wave compensated off-shore crane for unloading and loading a vessel which moves relative thereto due to wave motion, said crane including a line storage drum, with primary drive means, load supporting means, and wave compensating means, said drum being connected to said load supporting means by a line and being connected to said wave compensating means for compensating for said wave motion, said wave compensating means includng:

an hydraulic motor;

a differential gear, said motor being connected to said drum by said differential gear;

first, second and third preloaded hydro-pneumatic accumulators, said motor being connected on one side to said third accumulator and on the other side to said first and second accumulators, said first and second accumulators being preloaded by compressed gas in a closed pneumatic system whereby said first accumulator is preloaded to apply a light tension to said line which is equivalent to a minor proportion of the weight of said load, and said second accumulator is preloaded for applying a high tension to said line equivalent to a major proportion of but not exceeding the weight of said load when unloading and being greater than said load when loading;

an hydraulic selector valve, said selector valve connecting said first and second accumulators to said other side of said motor whereby said light and high tensions may be selectively applied to said line;

a fourth preloaded hydro-pneumatic accumulator connected to said other side of said motor for smoothing the operation of said motor when said selector valve is actuated for selectively connecting said first and second accumulators to said motor; and a pilot operated, non-return valve, said non-return valve being connected between said other side of said motor and said selector valve whereby said line is prevented from being lowered by said drum from the crest of said wave motion.

26. A crane according to claim 25 including means for detecting a predetermined level of hydraulic fluid in said first, second and third accumulators, a reservoir for hydraulic fluid, first, second and third solenoid valves connected between said reservoir and said first, second and third accumulators respectively, said solenoid valves being responsive to said level detecting means for transferring fluid from the reservoir to the respective accumulator for maintaining a predetermined minimum quantity of hydraulic fluid therein.

27. An improvement in wave compensating apparatus for an off-shore crane, said crane being provided for unloading and loading a vessel which moves relative thereto due to wave motion, said crane including primary drive means, load attachment means and line means connecting said primary drive means to said load attachment means said wave compensating apparatus including hydraulically driven means for taking and paying out said line means, hydro-pneumatic means acting on said hydraulically driven means for tensioning said line means to compensate for said wave motion, said hydro-pneumatic means including first accumulator means for imparting a light tension to said line means, said light tension being equivalent to a minor proportion of the weight of said load, and unidirectional locking means for preventing said line means from lowering said load from the crest of said wave motion, the improvement comprising:

second accumulator means for imparting a high tension to said line means; and selector means operatively coupled to said first and second accumulator means for selectively connecting said first and second accumulator means to said hydraulically driven means.

* * * * *